US006231130B1

(12) United States Patent
Chang

(10) Patent No.: US 6,231,130 B1
(45) Date of Patent: May 15, 2001

(54) WHEEL SUPPORT DEVICE

(76) Inventor: Wen-Chen Chang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/431,119

(22) Filed: Nov. 1, 1999

(51) Int. Cl.[7] ..... B60B 23/00; B60B 27/02; B60B 27/06; B60B 37/00; A45G 13/00

(52) U.S. Cl. ..... 301/111; 301/125; 190/18 A

(58) Field of Search ..... 301/111, 114, 301/121, 125, 137; 190/18 A

(56) References Cited

U.S. PATENT DOCUMENTS 4,995,487 * 2/1991 Plath ..... 190/18 A
5,253,739 * 10/1993 King ..... 190/18 A
5,431,428 * 7/1995 Marchwiak et al. ..... 190/18 A
5,498,010 * 3/1996 Stube ..... 190/18 A
5,524,737 * 6/1996 Wang ..... 190/18 A
5,575,361 * 11/1996 Chou ..... 190/18 A
5,875,519 * 3/1999 Chou ..... 301/111
5,918,710 * 7/1999 Sher ..... 190/18 A
6,024,194 * 2/2000 Chung-Hsien ..... 190/18 A
6,113,196 * 9/2000 Kuo ..... 301/120
6,116,701 * 9/2000 Kuo ..... 301/111
6,131,713 * 10/2000 Sher ..... 190/18 A
6,167,994 * 1/2001 Kuo et al. ..... 190/18 A

* cited by examiner

*Primary Examiner*—S. Joseph Morano
*Assistant Examiner*—Jason R. Bellinger

(57) ABSTRACT

A wheel support device has a triangular longitudinal casing, a triangular transverse casing, a convex housing, and a colored triangular plate. The convex housing has a through hole. The triangular longitudinal casing has a groove, a circular hole, and two round apertures. The colored triangular plate is inserted in the groove of the triangular longitudinal casing. The colored triangular plate has a post inserted in the circular hole of the triangular longitudinal casing and two columns inserted in the round apertures of the triangular longitudinal casing.

1 Claim, 3 Drawing Sheets

WHEEL SUPPORT DEVICE

BACKGROUND OF THE INVENTION

The present invention relates to a wheel support device. More particularly, the present invention relates to a wheel support device for a suitcase.

Referring to FIG. 1, a conventional wheel support device is disposed on a suitcase (not shown in the figure). The conventional wheel support device has a rectangular longitudinal casing 2, a rectangular transverse casing 1, and a convex housing 3. The convex housing 3 has a through hole 4. A wheel 5 is disposed on a bottom of the convex housing 3. The wheel 5 has a center hole 6. A pivot shaft 7 fastens the convex housing 3 and the wheel 5 pivotally through the through hole 4 of the convex housing 3 and the center hole 6 of the wheel 5.

SUMMARY OF THE INVENTION

An object of the present invention is to provide a wheel support device which has a colored triangular plate to reinforce the wheel support device.

Another object of the present invention is to provide a wheel support device which has a colored triangular plate to decorate the wheel support device.

Accordingly, a wheel support device has a triangular longitudinal portion, a triangular transverse casing, and a convex wheel housing portion. The convex wheel housing has a through hole. A wheel is disposed in the convex wheel housing portion. The wheel has a center hole. A pivot shaft for rotatably fastening the wheel to the convex housing to wheel portion by insertion the through hole of the convex housing and the center hole of the wheel. The triangular longitudinal portion has a generally triangular shaped recess, a circular hole, and two round apertures. A colored triangular plate is inserted in the generally triangular shaped recess of the triangular longitudinal portion. The colored triangular plate has a post for insertion into the circular hole of the triangular longitudinal casing and two columns for insertion into the round apertures of the triangular longitudinal portion.

DETAILED DESCRIPTION OF THE INVENTION

Figure 1:
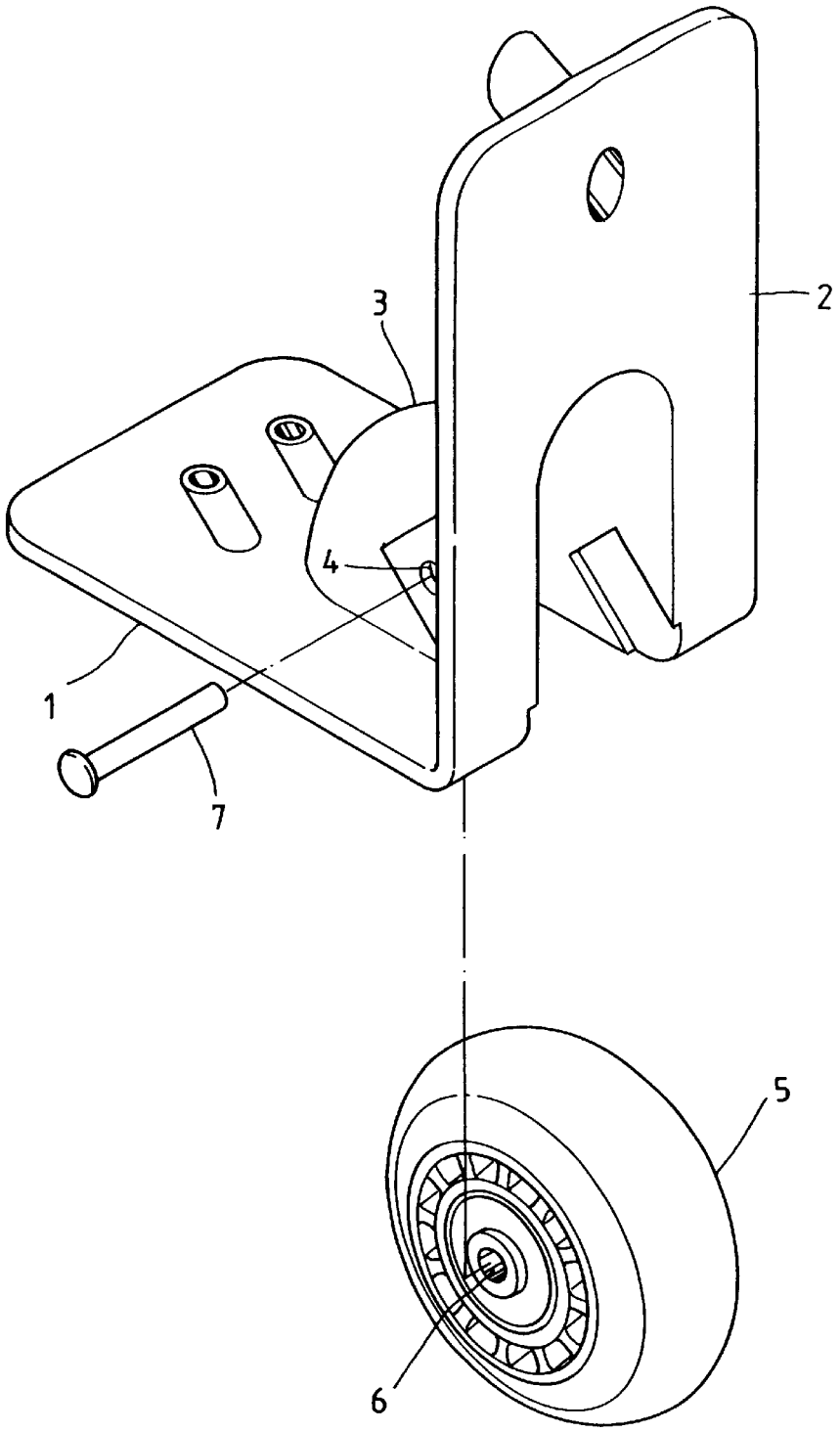
FIG. 1 PRIOR ART
FIG 1 is a perspective exploded view of a wheel and a conventional wheel support device of the prior art.
Figure 2:
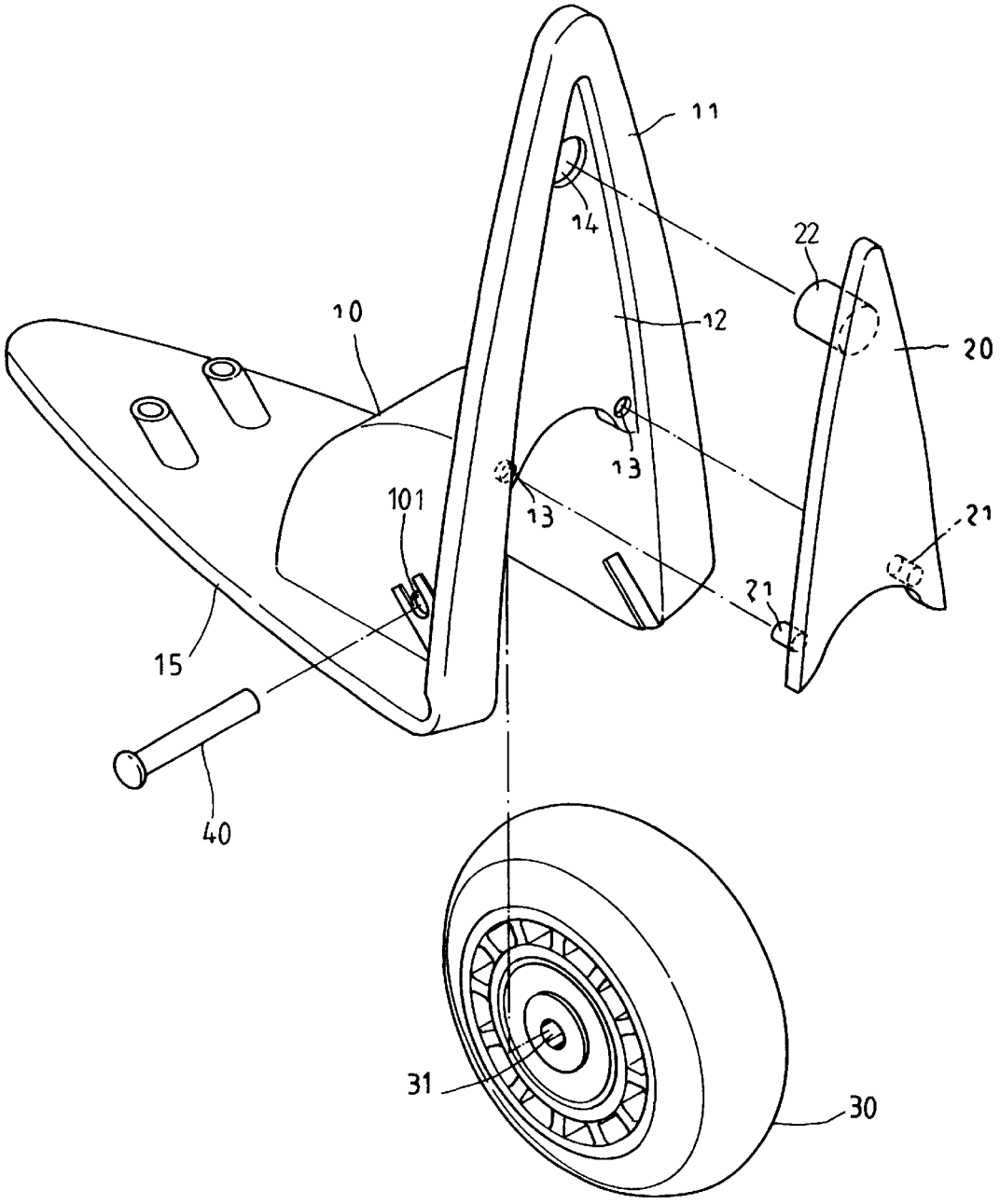
FIG. 2 is a perspective exploded view of a wheel and a wheel support device of a preferred embodiment in accordance with the present invention.
Figure 3:
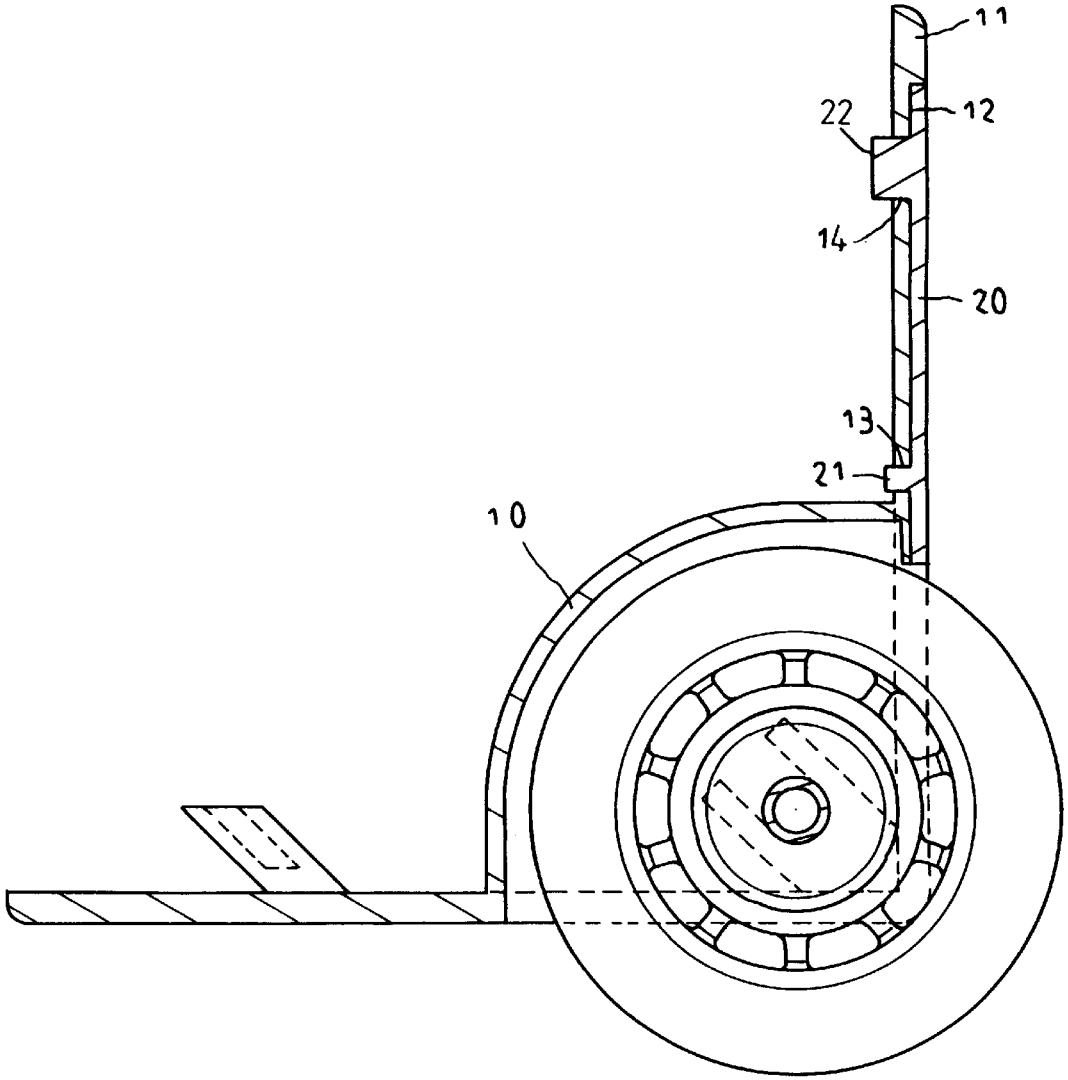
FIG. 3 is a sectional assembly view of a wheel and a wheel support device of a preferred embodiment in accordance with the present invention.

Referring to FIGS. 2 and 3, a wheel support device has a triangular longitudinal portion 11, a triangular transverse portion 15, and a convex wheel housing portion 10.

The convex wheel housing portion 10 has a through hole 101. A wheel 30 is disposed in the convex wheel housing portion 10. The wheel 30 has a center hole 31. A pivot shaft 40 for rotatably fastening the wheel 30 to the convex wheel housing portion 10 by insertion into the through hole 101 of the convex housing 10 and the center hole 31 of the wheel 30.

The triangular longitudinal portion 11 has a generally triangular shaped recess 12, a circular hole 14, and two round apertures 13.

A colored triangular plate 20 is inserted in the groove 12 of the triangular longitudinal portion 11.

The colored triangular plate 20 has a post 22 for insertion into the circular hole 14 of the triangular longitudinal casing 11 and two columns 21 for insertion into in the round apertures 13 of the triangular longitudinal portion 11.

The present invention is not limited to the above embodiments but various modification thereof may be made. Furthermore, various changes in form and detail may be made without departing from the scope of the present invention.

I claim:

1. A wheel support device having a substantially L-shaped housing that includes a triangular longitudinal portion, a triangular transverse portion, and a convex wheel housing portion integrally formed at an intersection of the longitudinal portion and the transverse portion, the convex wheel housing portion having a through hole, a wheel disposed in the convex wheel housing portion, the wheel having a center hole, a pivot shaft for rotatably fastening the wheel to the convex wheel housing portion by insertion into the through hole of the convex wheel housing and the center hole of the wheel, the wheel support device further comprising:

the triangular longitudinal portion having a generally triangular shaped recess, a circular hole, and two round apertures, a colored triangular plate for insertion into the generally triangular shaped recess of the triangular longitudinal portion, and the colored triangular plate having a post for insertion into the circular hole of the triangular longitudinal portion and two columns for insertion into the two round apertures of the triangular longitudinal portion.

* * * * *